US008026703B1

(12) United States Patent
Damaraju et al.

(10) Patent No.: US 8,026,703 B1
(45) Date of Patent: Sep. 27, 2011

(54) VOLTAGE REGULATOR AND METHOD HAVING REDUCED WAKEUP-TIME AND INCREASED POWER EFFICIENCY

(75) Inventors: Naga Radha Krishna Damaraju, La jolla, CA (US); Srikanth Reddy Tiyyagura, Bangalore (IN)

(73) Assignee: Cypress Semiconductor Corporation, San Jose, CA (US)

( * ) Notice: Subject to any disclaimer, the term of this patent is extended or adjusted under 35 U.S.C. 154(b) by 476 days.

(21) Appl. No.: 11/999,676

(22) Filed: Dec. 6, 2007

Related U.S. Application Data

(60) Provisional application No. 60/873,803, filed on Dec. 8, 2006.

(51) Int. Cl.
*G05F 1/565* (2006.01)

(52) U.S. Cl. ..... 323/275

(58) Field of Classification Search ..... 323/273–281, 323/226

See application file for complete search history.

(56) References Cited

U.S. PATENT DOCUMENTS

| | | | | |
|---|---|---|---|---|
| 5,754,037 | A | 5/1998 | Ezell et al. | |
| 5,973,419 | A * | 10/1999 | Kruppa et al. | 307/131 |
| 6,011,383 | A | 1/2000 | Dean et al. | |
| 6,522,111 | B2 | 2/2003 | Zadeh et al. | |
| 6,617,832 | B1 * | 9/2003 | Kobayashi | 323/266 |
| 6,879,142 | B2 | 4/2005 | Chen | |
| 6,973,337 | B2 * | 12/2005 | Jiguet et al. | 455/574 |
| 2005/0088153 | A1 * | 4/2005 | Suzuki | 323/274 |

* cited by examiner

*Primary Examiner* — Gary L Laxton
*Assistant Examiner* — Matthew Grubb

(57) ABSTRACT

A voltage regulator and method of using the same are provided that improve wakeup-time and reduce power wastage in switching a device from standby or sleep-mode to active mode. Generally, the voltage regulator includes: (i) a standby regulator having a high-impedance node (NGATE); (ii) an active regulator having a high-impedance node (dominant pole node); (iii) a compensation capacitor; and (iv) a switching circuit to couple the compensation capacitor to the high-impedance node (NGATE) of the standby regulator while the device is in sleep-mode to pre-charge the compensation capacitor, and to couple the compensation capacitor to the high-impedance node (dominant pole node) of the active regulator while the device is in active or non-sleep-mode. Other embodiments are also disclosed.

20 Claims, 4 Drawing Sheets

VOLTAGE REGULATOR AND METHOD HAVING REDUCED WAKEUP-TIME AND INCREASED POWER EFFICIENCY

CROSS-REFERENCE TO RELATED APPLICATIONS

The present application claims the benefit of priority under 35 U.S.C. 119(e) to U.S. Provisional Patent Application Ser. No. 60/873,803, entitled "A Voltage Regulator And Method Having Improved Wakeup-Time And Power Efficiency," filed Dec. 8, 2006, which application is hereby incorporated by reference in its entirety.

TECHNICAL FIELD

The present invention relates generally to reducing power consumption in electronic devices, and more particularly to voltage regulators and methods of using the same to reduce wakeup-time and power consumption in switching a voltage regulator from standby or sleep-mode to active mode.

BACKGROUND OF THE INVENTION

Many mobile or portable electronic devices, such as cellular telephones, portable digital assistants or PDAs, laptops, and other like devices, which operate on battery power. Thus, reducing power consumption is an extremely important issue, as consumers increasingly demand longer operating times between recharging.

One known method for reducing or minimizing power consumption in portable electronic devices is to place the device in a low-power standby or sleep-mode in which power to all unnecessary circuitry is reduced or removed while the device is idle. One circuit that is commonly powered down is a DC linear voltage regulator such as a low dropout (LDO) regulator. Voltage regulators are used to provide a stable, regulated output voltage to other circuits and elements in the portable electronic device. Frequently, these devices include distributed shared memory (DSM) having dual on-chip voltage regulators including an active regulator that is turned-OFF in standby mode and a standby regulator. In addition to being powered down while the chip or device is in sleep-mode, the active regulators can also be configured to serve different domains in the DSM, and thus some of the active regulators in a device or chip might be powered down or allowed to float their respective output voltages to enter deep-sleep mode.

It will be appreciated that a critical specification in any chip having such a dual regulator architecture is 'wake-up time' or the time it takes for the active regulator to come up to full power following sleep-mode.

A schematic diagram of a conventional active voltage regulator 100 is shown in FIG. 1. Referring to FIG. 1, the regulator 100 generally includes a two input operational amplifier (OPAMP 102) coupled to external power supplies $V_{CC}$ and $V_{SS}$, and having an input 104 coupled to a reference voltage ($V_{REF}$) and an output node 106 coupled to a voltage divider 108 including a vpwrcore made up of a chain of series connected N-channel metal-oxide-semiconductor (NMOS) transistors 110. A second input 112 to the OPAMP 102 provides feedback from the output node 106 through the voltage divider 108. A biasing transistor 114 provides biasing current ($I_{bias}$) through the OPAMP.

Typically, the regulator 100 further includes a compensation capacitor 116 directly connected to the output node 106 and the voltage divider 108 that must be charged when the regulator circuit is woken-up. Thus, one problem with conventional active voltage regulators 100 is the time it takes to charge this compensation capacitor 116, which accounts for the greater part of the wake-up time.

Another problem with conventional active voltage regulators 100 including a compensation capacitor 116, such as that shown in FIG. 1, is that the power used to charge the compensation capacitor is wasted each time the regulator toggles between standby and active mode.

One known method used to improve the wake-up time uses adaptive biasing configured to sense changes in the load current and alter an operating current of the regulator 100 in response, thereby enabling a more rapid charging of the compensation capacitor 116. Referring to FIG. 1, an adaptive biasing stack 118 typically includes a number of series connected MOS transistors coupled in parallel with the OPAMP 102 and the biasing transistor 114, and is configured to bias the voltage regulator 100 at a relatively low operating current for steady-state operation, while increasing the current during the transients, thereby improving the transient responses of the regulator.

Although the adaptive biasing stack 118 can improve wake-up time it does not solve the problem with wasting of power used to charge the compensation capacitor 116. In addition, adaptive biasing introduces a number of drawbacks or disadvantages including design complexity, overshooting on the output voltage, and the need for extra verification and/or mismatch concerns for the transistors in the adaptive biasing stack, which can result in either instability or increased quiescent current. Moreover, adaptive biasing does not work in headroom limited designs, such as pumped NGATE designs in which a first stage of the OPAMP operates on the pump as the adaptive biasing current needs to be controlled to prevent collapse of pump.

Accordingly, there is a need for a voltage regulator and method of using the same that reduces wakeup-time and power consumption in switching a device from standby or sleep-mode to active mode. It is further desirable that the voltage regulator and method eliminate the complex circuitry and potential instability problems due to transistor mismatch associated with adaptive biasing.

SUMMARY OF THE INVENTION

The present invention provides a solution to these and other problems, and offers further advantages over conventional voltage regulators and methods of operating the same.

In one aspect, the present invention is directed to a voltage regulator for improving wakeup-time and reducing power wastage in switching a device from standby or sleep mode to active mode. Generally, the voltage regulator includes a standby regulator capable of receiving a reference voltage and outputting a regulated output voltage when the voltage regulator is in a standby mode and including a high-impedance node, an active regulator capable of receiving a reference voltage and outputting a regulated output voltage when the voltage regulator is in an active mode and including a high-impedance node, a compensation capacitor; and a switching circuit. The switching circuit is adapted to couple the compensation capacitor to the high-impedance node of the standby regulator when the voltage regulator is in the standby mode to pre-charge the compensation capacitor, and to couple the compensation capacitor to the high-impedance node of the active regulator when the voltage regulator is in the active mode.

In one embodiment, the active regulator comprises an operational amplifier (OPAMP) with at least two inputs including a first input coupled to a reference voltage ($V_{REF}$) and an output coupled to the high-impedance node of the active regulator. Preferably, the active regulator further comprises a voltage divider coupled to the OPAMP through the high-impedance node of the active regulator, and to a second input to the OPAMP through a feedback path to receive a feedback voltage from the voltage divider. More preferably, the OPAMP comprises a two-stage operational amplifier including a first stage coupled through the high-impedance node of the active regulator to a charge pump, such as an NGATE charge pump.

In another aspect, the present invention is directed to methods of operating a voltage regulator to improve wake-up time and/or power efficiency. In one embodiment, the method includes steps of: (i) coupling a compensation capacitor to a high-impedance node of a standby regulator when the voltage regulator is in a standby mode to pre-charge the compensation capacitor; and (ii) switching the compensation capacitor to a high-impedance node of an active regulator when the voltage regulator is in an active mode. Preferably, the method further includes an initial step of pre-charging the compensation capacitor on powering-up of the voltage regulator.

More preferably, the active regulator comprises a two-stage operational amplifier (OPAMP) having a first stage coupled through the high-impedance node of the to a charge pump, and the method further includes the step of operating the charge pump using the pre-charged compensation capacitor on initial transition to active mode.

BRIEF DESCRIPTION OF THE DRAWINGS

These and various other features and advantages of the present invention will be apparent upon reading of the following detailed description in conjunction with the accompanying drawings and the appended claims provided below, where:

DETAILED DESCRIPTION

The present invention is directed to voltage regulating circuits or regulators and methods of using the same that improve wakeup-time and reduce power consumption in switching a device from standby or sleep-mode to active mode.

The voltage regulator and method of the present invention are particularly useful in mobile or portable devices, such as in cellular telephones, portable digital assistants (PDAs), laptops, and other like devices, that include distributed shared memory (DSM) on a single-chip and in which on-chip voltage regulators are used.

In the following description, for purposes of explanation, numerous specific details are set forth in order to provide a thorough understanding of the present invention. It will be evident, however, to one skilled in the art that the present invention may be practiced without these specific details. In other instances, well-known structures, and techniques are not shown in detail or are shown in block diagram form in order to avoid unnecessarily obscuring an understanding of this description.

Reference in the description to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment. The terms "to couple" and "to electrically couple" as used herein may include both to directly connect and to indirectly connect through one or more intervening components.

Briefly, the method of the present invention includes providing a voltage regulator including a standby regulator having a high-impedance node, an active regulator having a high-impedance node, and a compensation capacitor capable of being switched between the high-impedance node of the standby regulator and the high-impedance node of the active regulator. In standby mode of the voltage regulator, the compensation capacitor is coupled to the high-impedance node of the standby regulator to pre-charge the compensation capacitor. In operation, the compensation capacitor is coupled to the high-impedance node of the active regulator when the voltage regulator is in an active or non-sleep-mode, and switched back to the high-impedance node of the standby regulator when the voltage regulator enters a standby or sleep-mode. It will be appreciated by those skilled in the art that the voltage regulator and method of the present invention not only significantly reduce or improve wake-up of the active regulator, but also significantly reduce power wastage between standby-to-active mode transitions due to charging and discharging of the compensation capacitor typical of conventional voltage regulators.

A voltage regulator and method of operating the same according to an embodiment of the present invention will now be described in greater detail with reference to FIGS. 2 through 4.

Figure 1:
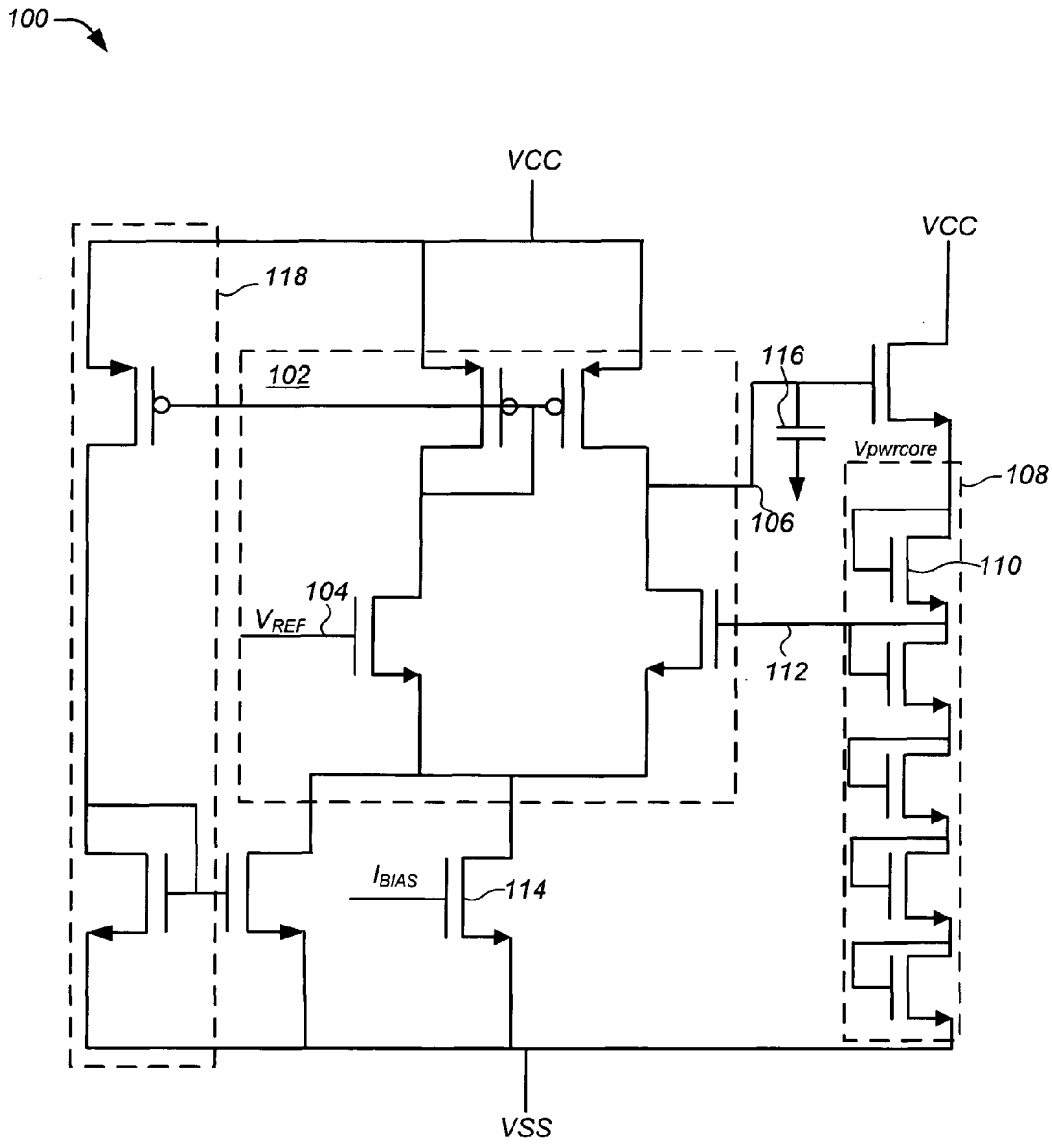
FIG. 1 (Prior Art)
FIG. 1 is a schematic diagram of a conventional active voltage regulator having a compensation capacitor and an adaptive biasing circuit to improve wake-up time.
Figure 2:
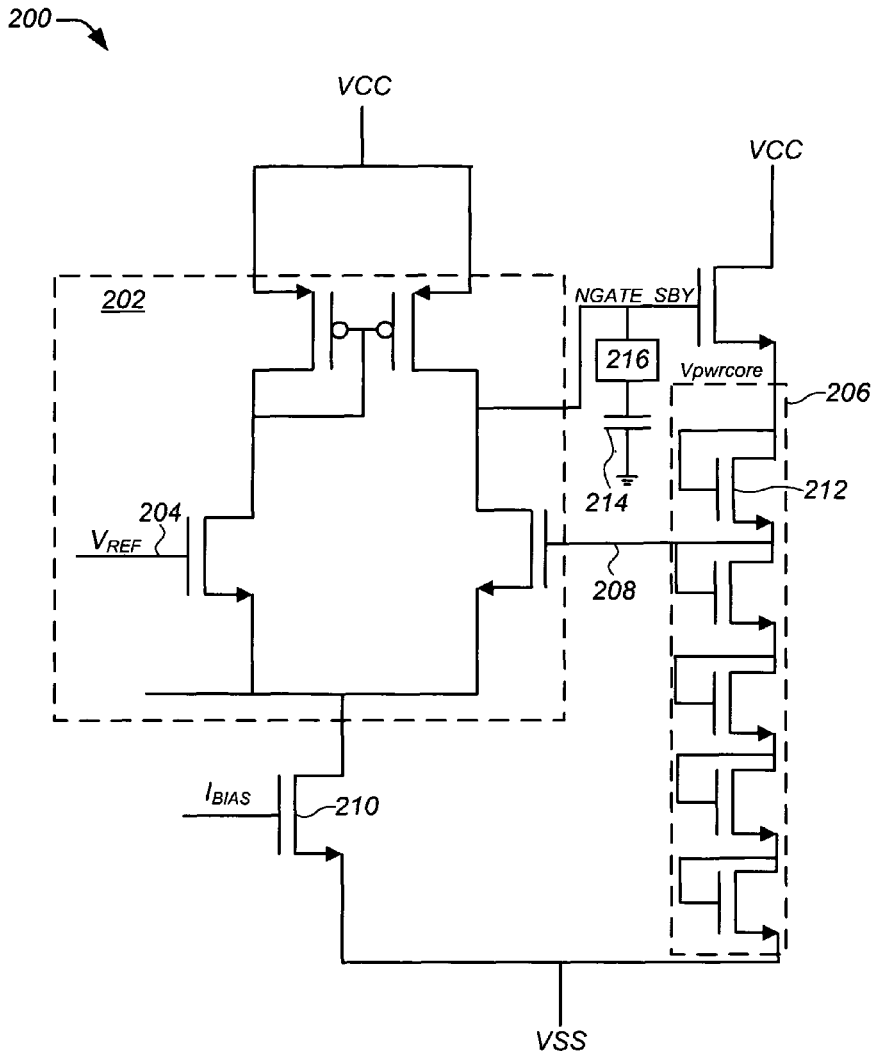
FIG. 2 is a schematic diagram of a standby regulator in a voltage regulator according to an embodiment of the present invention.

FIG. 2 is a schematic diagram of an embodiment of the standby regulator. Referring to FIG. 2, the standby regulator 200 generally includes a two input operational amplifier (OPAMP 202) coupled to external power supplies $V_{CC}$ and $V_{SS}$, and having a first input 204 coupled to a reference voltage ($V_{REF}$) and a high-impedance output node (NGATE_SBY) coupled to a voltage divider 206. A second input 208 to the OPAMP 202 provides feedback from the output node through the voltage divider 206. A biasing transistor 210 provides biasing current ($I_{bias}$) through the OPAMP 202.

In the embodiment shown, the voltage divider 206 includes a power core (vpwrcore) made up of a chain of series connected, substantially identical N-channel metal-oxide-semiconductor (NMOS) transistors 212 formed in a semiconductor substrate (not shown). However, it will be appreciated by those skilled in the art that other implementations for voltage dividers are possible and may be used without departing from the scope of the present invention. It will further be appreciated that the NMOS transistors of both the voltage divider 206 and the OPAMP 202 can be replaced with P-channel metal-oxide-semiconductor (PMOS) transistors or a combination of PMOS and NMOS transistors without departing from the spirit and scope of the invention.

In addition to the above, and in accordance with the present invention, the high-impedance output node (NGATE_SBY) is further coupled to an active mode compensation capacitor ($C_A$ 214) through a switching circuit 216 for use with an active regulator (not shown in this figure) operating in an active mode. In operation, the standby regulator 200 receives the reference voltage and outputs a regulated output voltage when the voltage regulator is in a standby or sleep-mode. In addition, the standby regulator 200 pre-charges the compensation capacitor ($C_A$ 214) when the voltage regulator is in sleep-mode to reduce or improve the wake-up time of an active regulator during transitions between standby-to-active modes.

Figure 3:
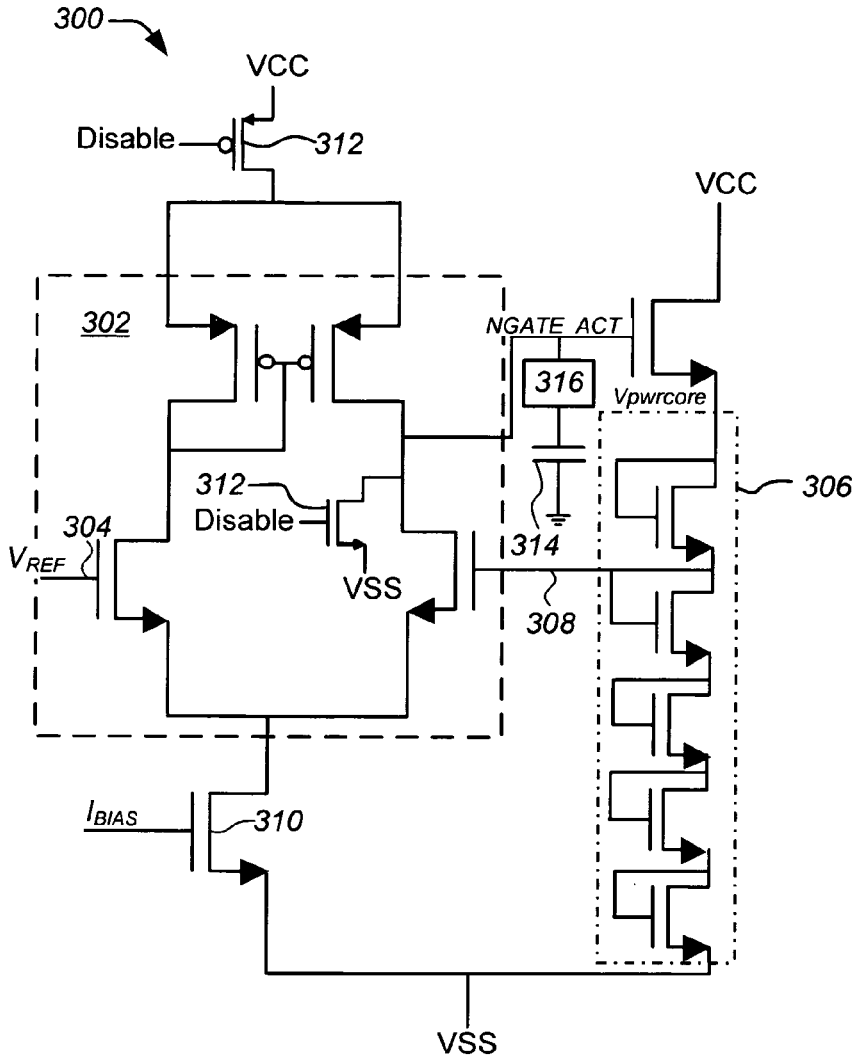
FIG. 3 is a schematic diagram of an active regulator in a voltage regulator according to an embodiment of the present invention.

A schematic diagram of an embodiment of the active regulator 300 is shown in FIG. 3. Referring to FIG. 3, the active regulator 300, like the standby regulator 200, includes a two input OPAMP 302 having a first input 304 coupled to $V_{REF}$, a high-impedance output node (NGATE_ACT) coupled to a voltage divider 306, and a second input 308 to provide feedback from the output node through the voltage divider 306. A biasing transistor 310 limits or controls biasing current ($I_{bias1}$) through the OPAMP 302.

In addition to the above, the active regulator 300 further includes disabling transistors 312 through which the output NGATE_ACT is coupled to $V_{CC}$ and $V_{SS}$, and which may be operated on receipt of a suitable disable signal to power down the active regulator 300 when the voltage regulator enters the standby or sleep-mode.

As with the standby regulator 200 described above, the high-impedance output node (NGATE_ACT) of the active regulator 300 is coupled to the compensation capacitor ($C_A$ 314) through the switching circuit 316. The coupling of the compensation capacitor ($C_A$ 400) and switching circuit 402 to the output nodes of the standby regulator 200 and active regulator 300, NGATE_SBY and NGATE_ACT respectively, are shown in FIG. 4.

Figure 4:
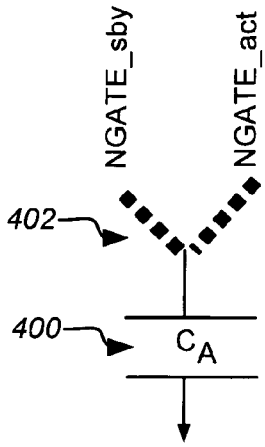
FIG. 4 is a schematic diagram of a compensation capacitor and a switching circuit or switch to switch it between a high-impedance node of the standby regulator and that of the active regulator to improve wake-up time and reduce power consumption.

Referring to FIGS. 3 and 4, in operation, the active regulator 300 receives the reference voltage ($V_{REF}$) and outputs a regulated output voltage when the voltage regulator is in a non-sleep or active-mode. As noted above, because the active mode compensation capacitor ($C_A$ 400) has been pre-charged by the standby regulator 200 when the voltage regulator is in sleep-mode the wake-up time of the active regulator 300 during transitions between standby-to-active modes is significantly reduced or improved. It will be appreciated by those skilled in the art that because the active mode compensation capacitor ($C_A$ 400) is pre-charged, there is no need to wait for the slew-limited OPAMP 302 of the active regulator 300 to bring up the output voltage from zero during transitions between standby-to-active modes. Preferably, the switching of the active mode compensation capacitor ($C_A$ 400) from the high-impedance output node (NGATE_ACT) of the active regulator 300 to that of the standby regulator (NGATE_SBY) during transitions between active-to-standby mode conserves the charge stored on the capacitor thereby increasing the power efficiency or reducing the power wastage of the voltage regulator.

In a preferred embodiment, the OPAMP 302 of the active regulator 300 comprises a two-stage operational amplifier having a first stage 318 operating a pumped NGATE charge pump 320 coupled to the high-impedance node of the active regulator (NGATE_ACT), and a second stage 322 having an output coupled to the high-impedance node of the active regulator. It will be appreciated by those skilled in the art that the pumped NGATE embodiment is the result of the substantial elimination of an adaptive biasing stack or circuit from the active regulator 300 and the standby regulator 200. Elimination of adaptive biasing is desirable since biasing current needs to be controlled to prevent collapse of pump. Uncontrolled biasing current causes uncontrolled current load on the pump. This will cause the output of the pump to collapse below its required value. It will further be appreciated that eliminating the need for adaptive biasing also reduces both the size and complexity and of the voltage regulator, and improves circuit performance which can be detrimentally impacted by overshoots on the output voltage caused by adaptive biasing.

Figure 5:
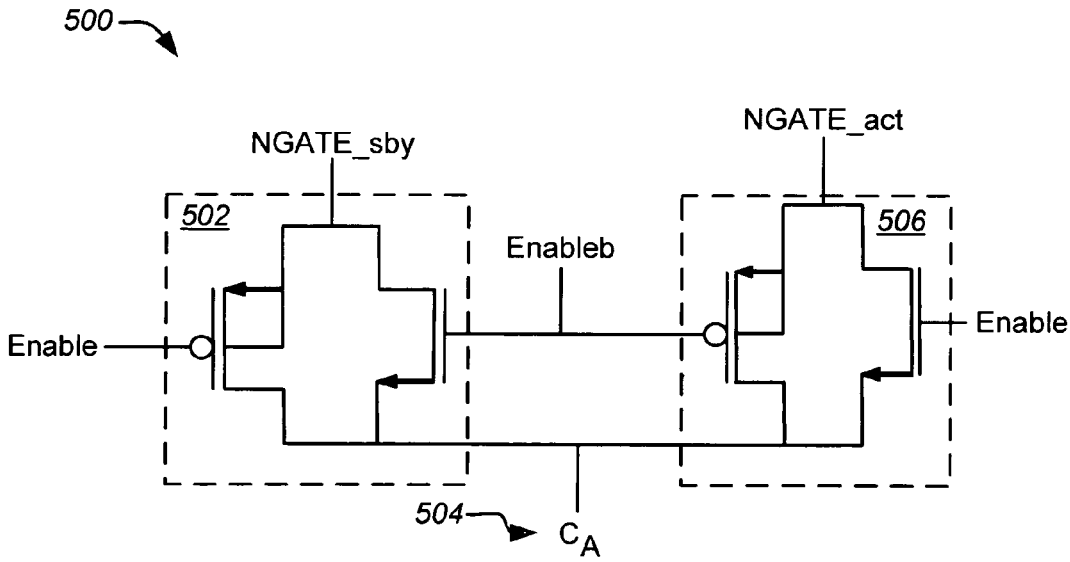
FIG. 5 is a detailed schematic diagram of the switching circuit according to an embodiment of the present invention.

Generally, the switching circuit can include any known semiconductor switching elements or circuits. A detailed schematic diagram of a switching circuit 500 according to one embodiment of the present invention is shown in FIG. 5. Referring to FIG. 5, switching circuit 500 includes first a pair of NMOS and PMOS transistors 502 connected in parallel between the high impedance node (NGATE_SBY) of the standby regulator and the compensation capacitor ($C_A$ 504), and a second pair of NMOS and PMOS transistors 506 connected in parallel between the high impedance node (NGATE_ACT) of the active regulator and $C_A$ 504. A high wake-up or enable signal that switches the voltage regulator to the active mode switches on the NMOS transistor of the second pair of transistors 506 while an inverse of this signal, enable-bar (enableb), causes the PMOS transistor to conduct, thereby coupling the compensation capacitor 504 to the high impedance node (NGATE_ACT) of the active regulator. The same signals, enable and enable-bar, simultaneously applied to the first pair of transistors 502 decouple or switch off the connection from the high impedance node (NGATE_SBY) of the standby regulator to the compensation capacitor 504. Similarly, switching the state of the enable and enable-bar signals when the voltage regulator enters the sleep mode will cause the first pair of transistors 502 to conduct coupling the compensation capacitor 504 the high impedance node (NGATE_SBY) of the standby regulator to hold the charge on the capacitor while simultaneously decoupling or switching off the connection to the high impedance node (NGATE_ACT) of the active regulator. It will further be appreciated that either the enable or enable-bar signal can be the same signal as the disable signals to transistors 312 in FIG. 3 used to power down the active regulator 300 when the voltage regulator enters the standby or sleep-mode.

Although shown and described above as a voltage divider having N-channel or NMOS transistors coupled to a NGATE charge pump, it will be appreciated by those skilled in the art that the NMOS and PMOS transistors in the regulator and the charge pump can be interchanged without departing from the scope of the present invention.

The advantages of the voltage regulator and method of the present invention over previous or conventional voltage regulators include: (i) improved wake-up time independent of the slew-rate of the OPAMP; (ii) improved power savings between active-standby transitions; (iii) simplicity of design and reduced circuit complexity through the elimination of adaptive biasing and the potential instability problems due to mismatch of electrical characteristics of transistors associated therewith; (iv) low and even ultra low power operation with high voltage-division accuracy; and (v) can be used with either NMOS- or PMOS-based regulators.

The foregoing description of specific embodiments and examples of the invention have been presented for the purpose of illustration and description, and although the invention has been described and illustrated by certain of the preceding examples, it is not to be construed as being limited thereby. The exemplary embodiments of the present invention described herein are not intended to be exhaustive or to limit the invention to the precise forms disclosed, and many modifications, improvements and variations within the scope of the invention are possible in light of the above teaching. It is intended that the scope of the invention encompass the generic area as herein disclosed, and by the claims appended hereto and their equivalents. The scope of the present invention is defined by the claims, which includes known equivalents and unforeseeable equivalents at the time of filing of this application.

What is claimed is:

1. A voltage regulator comprising:

a standby regulator capable of receiving a reference voltage and outputting a first regulated output voltage when the voltage regulator is in a standby mode, the standby regulator including a high-impedance node;

an active regulator capable of receiving a reference voltage and outputting a second regulated output voltage when the voltage regulator is in an active mode, the active regulator including a high-impedance node;

a compensation capacitor; and a switching circuit directly electrically connected to the compensation capacitor, the high-impedance node of the standby regulator, and the high-impedance node of the active regulator, the switching circuit configured to electrically connect the compensation capacitor to the high-impedance node of the standby regulator when the voltage regulator is in the standby mode to pre-charge the compensation capacitor, and to electrically connect the compensation capacitor to the high-impedance node of the active regulator when the voltage regulator is in the active mode.

2. The voltage regulator of claim 1, wherein the switching circuit is configured to electrically disconnect the compensation capacitor from the high-impedance node of the standby regulator when the voltage regulator is switched from standby mode to active mode, and to electrically disconnect the compensation capacitor from the high-impedance node of the active regulator when the voltage regulator is switched from active mode to standby mode.

3. The voltage regulator of claim 1, wherein the active regulator comprises an operational amplifier (OPAMP) having at least two inputs including a first input coupled to a reference voltage (VREF) and an output coupled to the high-impedance node of the active regulator.

4. The voltage regulator of claim 3, wherein the active regulator further comprises a voltage divider coupled to the OPAMP through the high-impedance node of the active regulator.

5. The voltage regulator of claim 4, wherein a second input to the OPAMP is coupled to the voltage divider through a feedback path to receive a feedback voltage therefrom.

6. A method comprising:

pre-charging a compensation capacitor by electrically connecting the compensation capacitor through a switching circuit to a high-impedance node of a standby regulator in a voltage regulator to pre-charge the compensation capacitor when the voltage regulator is in a standby mode; and reducing power consumption of the voltage regulator during transition from the standby mode to an active mode by electrically connecting the pre-charged compensation capacitor through the switching circuit to a high-impedance node of an active regulator when the voltage regulator is in the active mode to reduce charge dissipated from the compensation capacitor.

7. The method of claim 6, wherein reducing power consumption of the voltage regulator during transition from the standby mode to active mode comprises electrically disconnecting the pre-charged compensation capacitor from the high-impedance node of the standby regulator prior to electrically connecting the pre-charged compensation capacitor to the high-impedance node of the active regulator.

8. The method of claim 7, wherein pre-charging the compensation capacitor comprises electrically disconnecting the compensation capacitor from the high-impedance node of the active regulator prior to electrically connecting the compensation capacitor to the high-impedance node of the standby regulator.

9. The method of claim 6, wherein a first regulated output voltage of the voltage regulator in standby mode is substantially the same as a second regulated output voltage of the voltage regulator in active mode.

10. The method of claim 9, wherein the active regulator comprises an operational amplifier (OPAMP) comprising at least two inputs including a first input coupled to a reference voltage (VREF) and an output coupled to the high-impedance node of the active regulator, and wherein the method further comprises receiving the reference voltage to operate the voltage regulator is in the active mode.

11. The method of claim 10, wherein the active regulator further comprises a voltage divider coupled to the high-impedance node of the active regulator and through a feedback path to a second input to the OPAMP, and wherein the method further comprises receiving a feedback voltage from the voltage divider to operate the voltage regulator is in the active mode.

12. The method of claim 10, wherein a time to transition from the standby mode to the active mode is not limited by a time for the OPAMP output to rise to the second regulated output voltage.

13. The method of claim 6, wherein further comprising initially pre-charging the compensation capacitor on powering-up of the voltage regulator.

14. A method comprising:

pre-charging a compensation capacitor by electrically connecting the compensation capacitor through a switching circuit to a high-impedance node of a standby regulator in a voltage regulator to pre-charge the compensation capacitor when the voltage regulator is in a standby mode; and reducing wake-up time of the voltage regulator during transition from the standby mode to an active mode without use of an adaptive biasing stack by electrically connecting the pre-charged compensation capacitor through the switching circuit to a high-impedance node of an active regulator when the voltage regulator transitions from the standby mode to active mode.

15. The method of claim 14, wherein reducing wake-up time of the voltage regulator during transition from the standby mode to active mode comprises electrically disconnecting the pre-charged compensation capacitor from the high-impedance node of the standby regulator prior to electrically connecting the pre-charged compensation capacitor to the high-impedance node of the active regulator.

16. The method of claim 15, wherein pre-charging the compensation capacitor comprises electrically disconnecting the compensation capacitor from the high-impedance node of the active regulator prior to electrically connecting the compensation capacitor to the high-impedance node of the standby regulator.

17. The method of claim 14, wherein a first regulated output voltage of the voltage regulator in standby mode is substantially the same as a second regulated output voltage of the voltage regulator in active mode.

18. The method of claim 17, wherein the active regulator comprises an operational amplifier (OPAMP) comprising at least two inputs including a first input coupled to a reference voltage (VREF) and an output coupled to the high-impedance node of the active regulator, and wherein the method further comprises receiving the reference voltage to operate the voltage regulator is in the active mode.

19. The method of claim 18, wherein the active regulator further comprises a voltage divider coupled to the high-impedance node of the active regulator and through a feedback path to a second input to the OPAMP, and wherein the method further comprises receiving a feedback voltage from the voltage divider to operate the voltage regulator is in the active mode.

20. The method of claim 18, wherein the wake-up time of the voltage regulator during transition from the standby mode to an active mode is not limited by a time for the OPAMP output to rise to the second regulated output voltage.

* * * * *